US012072114B2

(12) United States Patent
Ioannou et al.

(10) Patent No.: US 12,072,114 B2
(45) Date of Patent: Aug. 27, 2024

(54) DISTRIBUTED ADAPTIVE CONTROL OF A MULTI-ZONE HVAC SYSTEM

(71) Applicant: UNIVERSITY OF SOUTHERN CALIFORNIA, Los Angeles, CA (US)

(72) Inventors: Petros Ioannou, Palos Verdes Estates, CA (US); Georgios Lymperopoulos, Los Angeles, CA (US)

(73) Assignee: University of Southern California, Los Angeles, CA (US)

( * ) Notice: Subject to any disclaimer, the term of this patent is extended or adjusted under 35 U.S.C. 154(b) by 10 days.

(21) Appl. No.: 16/797,218

(22) Filed: Feb. 21, 2020

(65) Prior Publication Data

US 2020/0271347 A1 Aug. 27, 2020

Related U.S. Application Data

(60) Provisional application No. 62/808,531, filed on Feb. 21, 2019.

(51) Int. Cl.
*F24F 11/63* (2018.01)
*F24F 3/052* (2006.01)

(52) U.S. Cl.
CPC ..... *F24F 11/63* (2018.01); *F24F 3/0527* (2013.01)

(58) Field of Classification Search
CPC ..... F24F 11/63; F24F 3/0527; F24F 2110/10; F24F 2110/12; F24F 11/80
See application file for complete search history.

(56) References Cited

U.S. PATENT DOCUMENTS 6,240,324 B1 * 5/2001 Preska ..... G05B 13/024 700/8
11,927,357 B2 * 3/2024 Bell ..... F24F 11/89
2003/0153986 A1 * 8/2003 Salsbury ..... G05B 5/01 700/11

(Continued)

OTHER PUBLICATIONS

N.T. Nguyen, Model-Reference Adaptive Control, Advanced Textbooks in Control and Signal Processing, Mar. 2, 2018, Springer, Cham, pp. 83-123. https://doi.org/10.1007/978-3-319-56393-0_5 (Year: 2018).*

(Continued)

*Primary Examiner* — Thomas C Lee
*Assistant Examiner* — Anzuman Sharmin
(74) *Attorney, Agent, or Firm* — Brooks Kushman P.C.

(57) ABSTRACT

A distributive adaptive control system for HVAC control and a method for controlling the temperature in a building with one or more zones is disclosed. The control system and method are based on a design that may accommodate buildings with multiple interconnected thermal zones. The system includes a controller for each zone of the building. Each controller is designed to regulate temperature while attenuating the effect of directly neighboring zones, wall temperature, weather conditions and heat gains. The control mechanism does not require any prior accurate knowledge of system parameters but instead calibrates itself to meet the needs of each thermal zone. An appropriate adaptive law may be used for learning the building and HVAC system parameters and auto-calibrating the controller. The proposed system and method can extend the life of the HVAC by compensating for a wide range of tear and wear and other defects in the equipment.

21 Claims, 9 Drawing Sheets

(56) References Cited

U.S. PATENT DOCUMENTS

2003/0213256 A1* 11/2003 Ueda ..... F25B 1/02 62/230
2005/0087616 A1* 4/2005 Attridge ..... F24F 11/30 165/254
2006/0091227 A1* 5/2006 Attridge, Jr. ..... F24F 11/74 700/277
2012/0118554 A1* 5/2012 Mathur ..... F28D 20/02 165/287
2012/0232702 A1* 9/2012 Vass ..... G05D 23/1934 700/277
2012/0253524 A1* 10/2012 Norrell ..... F24F 11/72 700/277
2014/0257528 A1* 9/2014 Perez ..... G05B 13/047 700/46
2015/0370271 A1* 12/2015 Raghunathan ..... F24F 11/30 700/277
2016/0109147 A1* 4/2016 Uno ..... F24F 11/64 700/276
2016/0161139 A1* 6/2016 Asmus ..... F24F 11/58 165/208
2018/0363932 A1* 12/2018 Salsbury ..... G05B 19/048
2019/0346170 A1* 11/2019 Benefield ..... G01N 1/2273
2020/0166230 A1* 5/2020 Ng ..... F24F 11/56

OTHER PUBLICATIONS

Lymperopoulos, G. et al., "Building temperature regulation in a multi-zone HVAC system using distributed adaptive control," Energy & Buildings v. 215 (2020), pp. 1-15.
Lymperopoulos, G. et al., "Distributed Adaptive Control of Multi-Zone HVAC Systems," 2019 27th Mediterranean Conference on Control and Automation (MED), Jul. 1-4, 2019.
Lymperopoulos, G. et al., "Distributed adaptive HVAC control for multi-zone buildings," in Proc. of the 58th Conference on Decision and Control (CDC), IEEE, 2019.
Ioannou P. et al, "Robust Adaptive Control," Dover Publications, Inc., 2012, 834 pgs.
Ioannou, P. et al., "Adaptive Control Tutorial (Advances in Design and Control)," Society of Industrial and Applied Mathematics, 2006, 403 pgs.

* cited by examiner

| | |
|---|---|
| $T_{z,i}$: Zone Temperature | $T_o$: Outside Temperature |
| $T_{w,ij}$ : Surrounding Surface Temperature | $T_{sa,i}$: Supply Air Temperature |
| $T_{z,p}$, $T_{z,k}$: Temperature of neighboring zones | $\Theta_i$: Estimated Controller Gains |
| $T_{m,i}$: Target Temperature | |

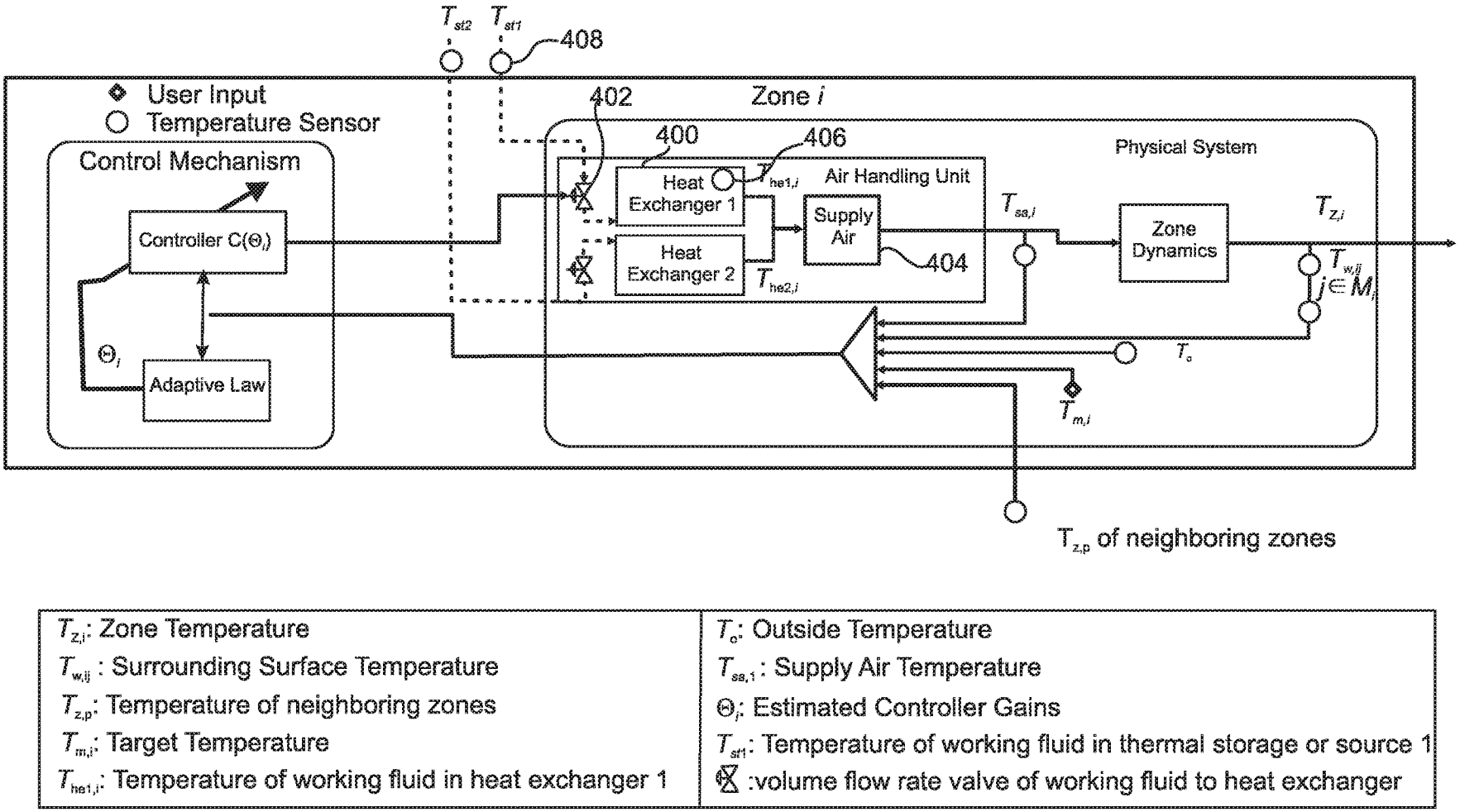

$T_{Z,i}$: Zone Temperature
$T_{w,ij}$ : Surrounding Surface Temperature
$T_{z,p}$: Temperature of neighboring zones
$T_{m,i}$: Target Temperature
$T_{he1,i}$: Temperature of working fluid in heat exchanger 1
$T_o$: Outside Temperature
$T_{ss,1}$ : Supply Air Temperature
$\Theta_i$: Estimated Controller Gains
$T_{sf1}$: Temperature of working fluid in thermal storage or source 1
:volume flow rate valve of working fluid to heat exchanger

*Fig. 4*

DISTRIBUTED ADAPTIVE CONTROL OF A MULTI-ZONE HVAC SYSTEM

CROSS-REFERENCE TO RELATED APPLICATIONS

This application claims the benefit of U.S. provisional application Ser. No. 62/808,531 filed Feb. 21, 2019 the disclosure of which is hereby incorporated in its entirety by reference herein.

TECHNICAL FIELD

In at least one aspect, the present invention is related to HVAC control systems for building structures with one or more zones.

BACKGROUND

Heating, ventilation and air-conditioning systems (HVAC) are the largest contributors of building energy consumption. Such systems are important for improving the quality of life in buildings by providing comfortable temperature and air quality under indoor conditions. Enhancing their efficiency may lead to reduced energy needs as well as improved climate conditions for occupants. Recent advances in sensors, electronics and communications motivate a lot of research for designing and optimizing HVAC control systems for buildings.

HVAC systems are complicated systems that may consist of several parts, which should operate efficiently in order to regulate climate conditions in a building structure. Examples of HVAC equipment include air-handling units or air-terminal devices, which are used to add or remove heat to the zone in order to modify its temperature and overcome internal and external gains and losses. Other examples of HVAC equipment include heat exchangers, such as heating and cooling coils.

Operating and controlling such systems may be based on different approaches which include but are not limited to appropriately selecting structure and hierarchy for the HVAC control scheme as well as control system parameters, such as appropriate materials and equipment size, understanding system dynamics and taking into account several factors, such as human activity.

SUMMARY

In at least one aspect, a method for controlling an HVAC system in a building with multiple zones using a distributed control approach that combines adaptation and learning is provided.

In another aspect, an HVAC control system in which a controller is assigned to each zone is provided.

In another aspect, an HVAC control system includes one or more zone temperature sensors positioned in one or more building zones that measure zone temperature; one or more or zero wall temperature sensors that measure wall temperatures of one or more walls bordering the zones; one or more neighboring zone temperature sensors that measure neighboring zone temperatures of one or more neighboring zones; one or more supply air temperature sensors that measure supply air temperatures of one or more zones; a communication network between neighboring zones; and an outside temperature sensor that measures outside temperature. The HVAC control system also includes one or more air handling units that provide supply air to one or more target zones at a supply air temperature and one or more closed-loop controllers that implement one or more estimated adaptive control laws to set the supply air temperature or the volume flow rate of working fluid in the heat exchanger or the appropriate control input of the HVAC system. The estimated adaptive control law minimizes effects of surroundings and activity in the target zone. The controller of each zone may also have one or more working fluid temperature sensors that measure temperature of working fluids in heat exchangers; and one or more working fluid temperature sensors that measure temperatures of working fluids in thermal storages (e.g. thermal storage devices) or thermal sources. Each zone may have one or more heat exchangers, and one or more thermal storages or sources. In a refinement, the estimated adaptive control law includes (e.g., receive as inputs) zone temperature, wall temperature(s) in the target zone, temperature(s) of neighboring zones, target temperature, outside temperature, supply air temperature each connected to a corresponding automatically adjusted (adaptive) gain such that the zone temperature approaches the target zone temperature. In another refinement, the estimated adaptive control law may also include temperature of working fluid in heat exchanger, and temperature of working fluid in thermal storage or source each connected to a corresponding automatically adjusted (adaptive) gain such that the zone temperature approaches the target zone temperature. The HVAC control system results in the zone temperature approaching the target zone temperature with predetermined response time (e.g., desired or optimal response time) in each zone. In a refinement, the adaptive control law is automatically learning the building and HVAC parameters. In a variation, controller parameters estimated by the adaptive law may change. In some variations, one or more controller parameters may not be changed by the adaptive law. In a refinement, the control system allows communication between zones with some delay. In some variations, the controller does not require any knowledge of the model parameters, and such parameters may change with time. In some variations, the HVAC control system calculates the appropriate (e.g., optimal) supply air temperature. In some variations, the HVAC control system calculates the appropriate volume flow rate (e.g., an optimal or predetermined volume flow rate) of working fluid in the heat exchangers.

In another aspect, a distributed adaptive HVAC control system for controlling temperature in a multizone building is provided, wherein one or more zones of the multi-zone building include any of the HVAC control system properties.

In another aspect, a method for controlling temperature includes measuring a target zone temperature for a target zone; measuring wall temperatures of one or more or zero walls bordering the target zone; measuring and communicating neighboring zone temperatures of one or more neighboring zones to the target zone; measuring outside temperature; setting a target temperature for the target zone; providing supply air to the target zone at a supply air temperature, the supply air temperature being matched by the air handling unit to the desired supply air temperature, the supply air temperature being determined from an estimated adaptive control law, the estimated adaptive control law minimizing effects of surroundings and activity in the target zone. The method may further include measuring temperatures of working fluids in one or more heat exchangers; measuring temperatures of working fluids in one or more thermal storages or sources; providing working fluid in the heat exchanger, the volume flow rate of the working fluid being determined from an estimated adaptive control law. The method may include the desired supply air temperature to be controlled by the HVAC control system. The method may include the desired volume flow rate of the working fluids in the heat exchangers to be controlled by the HVAC control system. In some variations, the method may estimate the controlling input of the HVAC system. In some variations, the method for controlling temperature in a multizone building, wherein the method is any combination of the individual properties of the method. In some variations, the HVAC control system is expected to extend the life of the HVAC by compensating for a wide range of tear and wear and other defects in the equipment.

In another aspect, a supply air control system is provided. Typically, the supplied air from the air unit has a direct impact on zone temperature. In some variations, climate conditions of neighboring zones may affect zone temperature through walls. In some variations, open surfaces between zones let heat transfer between zones. In some variations, heat gains or disturbances may affect zone temperature. In some variations, weather conditions may also affect zone temperature. In some variations, to make the zone temperature reach the desired temperature target in each zone, the optimal supply air temperature may be calculated by the controller. The air handling unit provides supply air with a temperature that matches the desired one. In some configurations, the HVAC equipment may provide supply air with constant volume flow rate. In one configuration, for each zone the signals that are available for measurement and use in the control design are the zone temperature, the temperature of the wall, the desired temperature of the supply air, the temperature target, as well as the zone temperature of the neighboring zones and the outside temperature. In some variations, the control input is the supply air temperature.

In still another aspect, a control system for an HVAC System with heat exchangers is provided. In one or more variations, the supply air temperature may be affected by the temperature of the working fluid in the heat exchanger. In some variations, zone temperature may affect supply air temperature through the return. In some variations, disturbances may affect supply air temperature. In some variations, weather conditions may affect supply air temperature. In some variations, the temperature of the working fluid in the heat exchanger may be affected by supply air temperature. In one or more configurations, the temperature of the working fluid in the heat exchanger may be affected by the temperature of the working fluid in the thermal storage or thermal source. In some variations, disturbances may affect the temperature of the working fluid in the heat exchanger. In some variations, weather conditions may affect the temperature of the working fluid in the heat exchanger. In some variations, to make the zone temperature reach the desired temperature target in each zone, the optimal volume flow rate of the working fluid in the heat exchanger may be calculated by the controller. In a refinement, the controller may have a cascade structure. In one configuration, for each zone, the signals that are available for measurement and use in the control design are the zone temperature, the temperature of the wall, the desired temperature of the supply air, the temperature target, as well as the zone temperature of the neighboring zone, the outside temperature, the temperature of the working fluid of the heat exchanger, the temperature of the working fluid in the thermal storage or thermal source and the volume flow rate of the working fluid in the heat exchanger. In at least one aspect, the control scheme does not need exact information on system dynamics. In a variation, the control input is the volume flow rate of the working fluid in one or more heat exchangers.

In yet another aspect, the distributed adaptive control scheme guarantees the boundedness of the temperature tracking error of every zone. In one or more variations, zone temperature is guaranteed to approach the desired target temperature in every zone.

In yet another aspect, the HVAC control system set forth herein extends life of HVAC equipment by compensating for a wide range of tear and wear and other equipment defects.

In yet another aspect, the one or more closed-loop controllers do not require any knowledge of model parameters that are allowed to change with time.

In yet another aspect, system parameters are considered unknown and controller gains are estimated on-line by an adaptive law.

BRIEF DESCRIPTION OF THE DRAWINGS

FIGS. 2B-1, 2B-2, 2B-3, and 2B-4: Exemplary supply air temperature of zones in FIGS. 2A-1, 2A-2, 2A-3, and 2A-4.

FIG. 3: Exemplary gain adaptation for one year.

FIG. 4: Exemplary block diagram of one embodiment that includes heat exchangers.

DETAILED DESCRIPTION

Figure 1A:
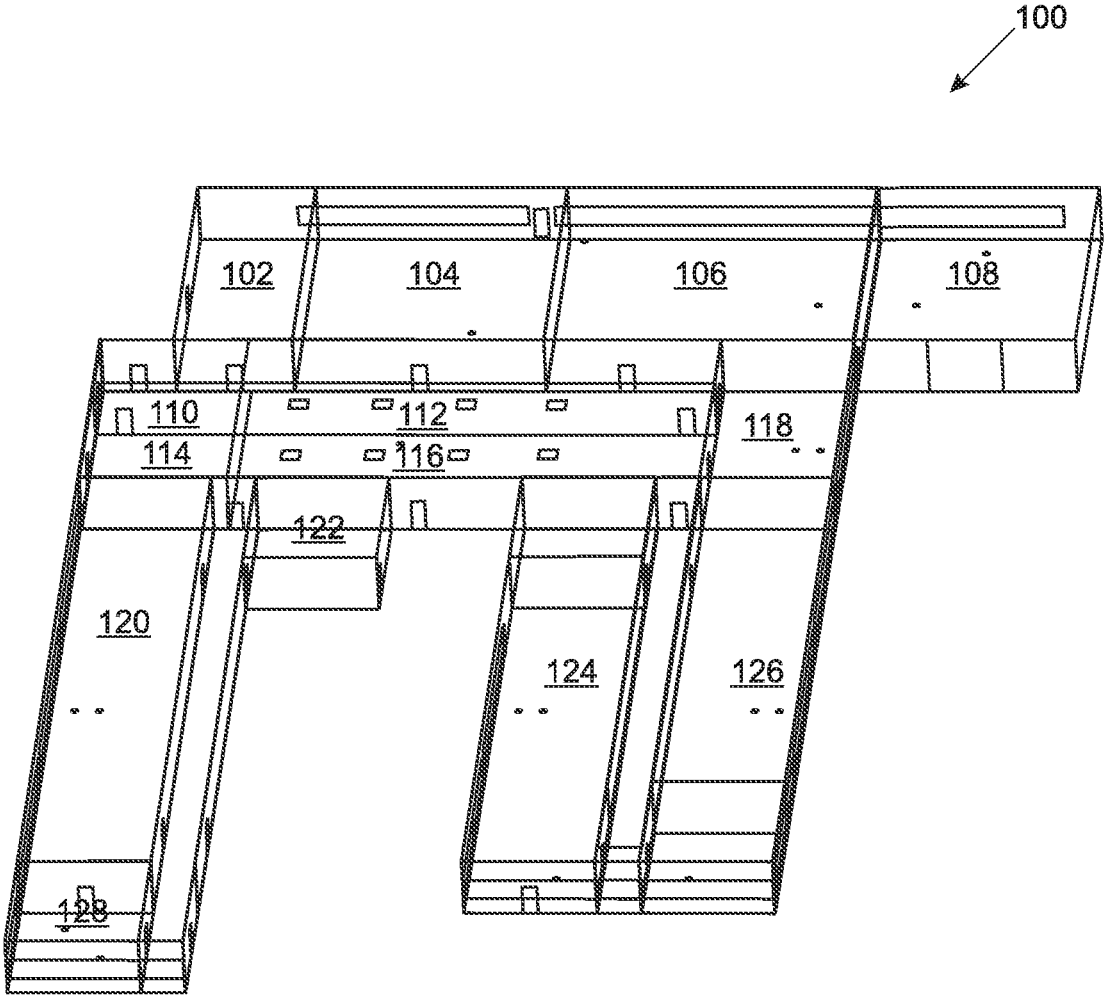
FIG. 1A: A perspective view of an example model of multi-zone building.

Reference will now be made in detail to presently preferred compositions, embodiments and methods of the present invention, which constitute the best modes of practicing the invention presently known to the inventors. The Figures are not necessarily to scale. However, it is to be understood that the disclosed embodiments are merely exemplary of the invention that may be embodied in various and alternative forms. Therefore, specific details disclosed herein are not to be interpreted as limiting, but merely as a representative basis for any aspect of the invention and/or as a representative basis for teaching one skilled in the art to variously employ the present invention.

It is also to be understood that this invention is not limited to the specific embodiments and methods described below, as specific components and/or conditions may, of course, vary. Furthermore, the terminology used herein is used only for the purpose of describing particular embodiments of the present invention and is not intended to be limiting in any way.

It must also be noted that, as used in the specification and the appended claims, the singular form "a," "an," and "the" comprise plural referents unless the context clearly indicates otherwise. For example, reference to a component in the singular is intended to comprise a plurality of components.

The term "comprising" is synonymous with "including," "having," "containing," or "characterized by." These terms are inclusive and open-ended and do not exclude additional, unrecited elements or method steps.

The phrase "consisting of" excludes any element, step, or ingredient not specified in the claim. When this phrase appears in a clause of the body of a claim, rather than immediately following the preamble, it limits only the element set forth in that clause; other elements are not excluded from the claim as a whole.

The phrase "consisting essentially of" limits the scope of a claim to the specified materials or steps, plus those that do not materially affect the basic and novel characteristic(s) of the claimed subject matter.

With respect to the terms "comprising," "consisting of," and "consisting essentially of," where one of these three terms is used herein, the presently disclosed and claimed subject matter can include the use of either of the other two terms.

It should also be appreciated that integer ranges explicitly include all intervening integers. For example, the integer range 1-10 explicitly includes 1, 2, 3, 4, 5, 6, 7, 8, 9, and 10. Similarly, the range 1 to 100 includes 1, 2, 3, 4 . . . 97, 98, 99, 100. Similarly, when any range is called for, intervening numbers that are increments of the difference between the upper limit and the lower limit divided by 10 can be taken as alternative upper or lower limits. For example, if the range is 1.1 to 2.1 the following numbers 1.2, 1.3, 1.4, 1.5, 1.6, 1.7, 1.8, 1.9, and 2.0 can be selected as lower or upper limits.

The term "connected to" means that the electrical components referred to as connected to are in electrical communication. In a refinement, "connected to" means that the electrical components referred to as connected to are directly wired to each other. In another refinement, "connected to" means that the electrical components communicate wirelessly or by a combination of wired and wirelessly connected components. In another refinement, "connected to" means that one or more additional electrical components are interposed between the electrical components referred to as connected to with an electrical signal from an originating component being processed (e.g., filtered, amplified, modulated, rectified, attenuated, summed, subtracted, etc.) before being received to the component connected thereto.

The term "electrical communication" means that an electrical signal is either directly or indirectly sent from an originating electronic device to a receiving electrical device. Indirect electrical communication can involve processing of the electrical signal, including but not limited to, filtering of the signal, amplification of the signal, rectification of the signal, modulation of the signal, attenuation of the signal, adding of the signal with another signal, subtracting the signal from another signal, subtracting another signal from the signal, and the like. Electrical communication can be accomplished with wired components, wirelessly connected components, or a combination thereof.

The term "electrical signal" refers to the electrical output from an electronic device or the electrical input to an electronic device. The electrical signal is characterized by voltage and/or current. The electrical signal can be stationary with respect to time (e.g., a DC signal) or it can vary with respect to time.

The term "electronic component" refers is any physical entity in an electronic device or system used to affect electron states, electron flow, or the electric fields associated with the electrons. Examples of electronic components include, but are not limited to, capacitors, inductors, resistors, thyristors, diodes, transistors, etc. Electronic components can be passive or active.

The term "electronic device" or "system" refers to a physical entity formed from one or more electronic components to perform a predetermined function on an electrical signal.

It should be appreciated that in any figures for electronic devices, a series of electronic components connected by lines (e.g., wires) indicates that such electronic components are in electrical communication with each other. Moreover, when lines directed connect one electronic component to another, these electronic components can be connected to each other as defined above.

It should be appreciated that a property or parameter desired as "optimal" means that the property or parameter provides the best possible performance. In a refinement, "optimal" means "predetermined" or desired with "desired" being synonymous with "predetermined."

Throughout this application, where publications are referenced, the disclosures of these publications in their entireties are hereby incorporated by reference into this application to more fully describe the state of the art to which this invention pertains.

Abbreviations:

"HVAC" means heating, ventilation, and air conditioning.

Figure 1B:
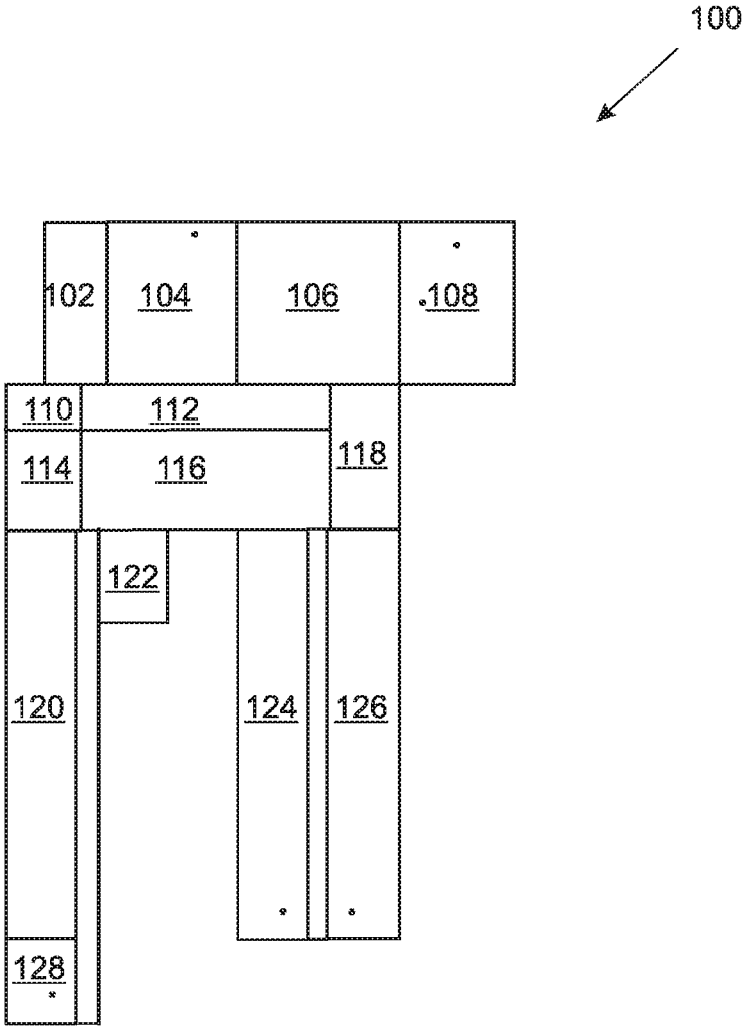
FIG. 1B: A top view of the example model of multi-zone building.
Figure 1C:
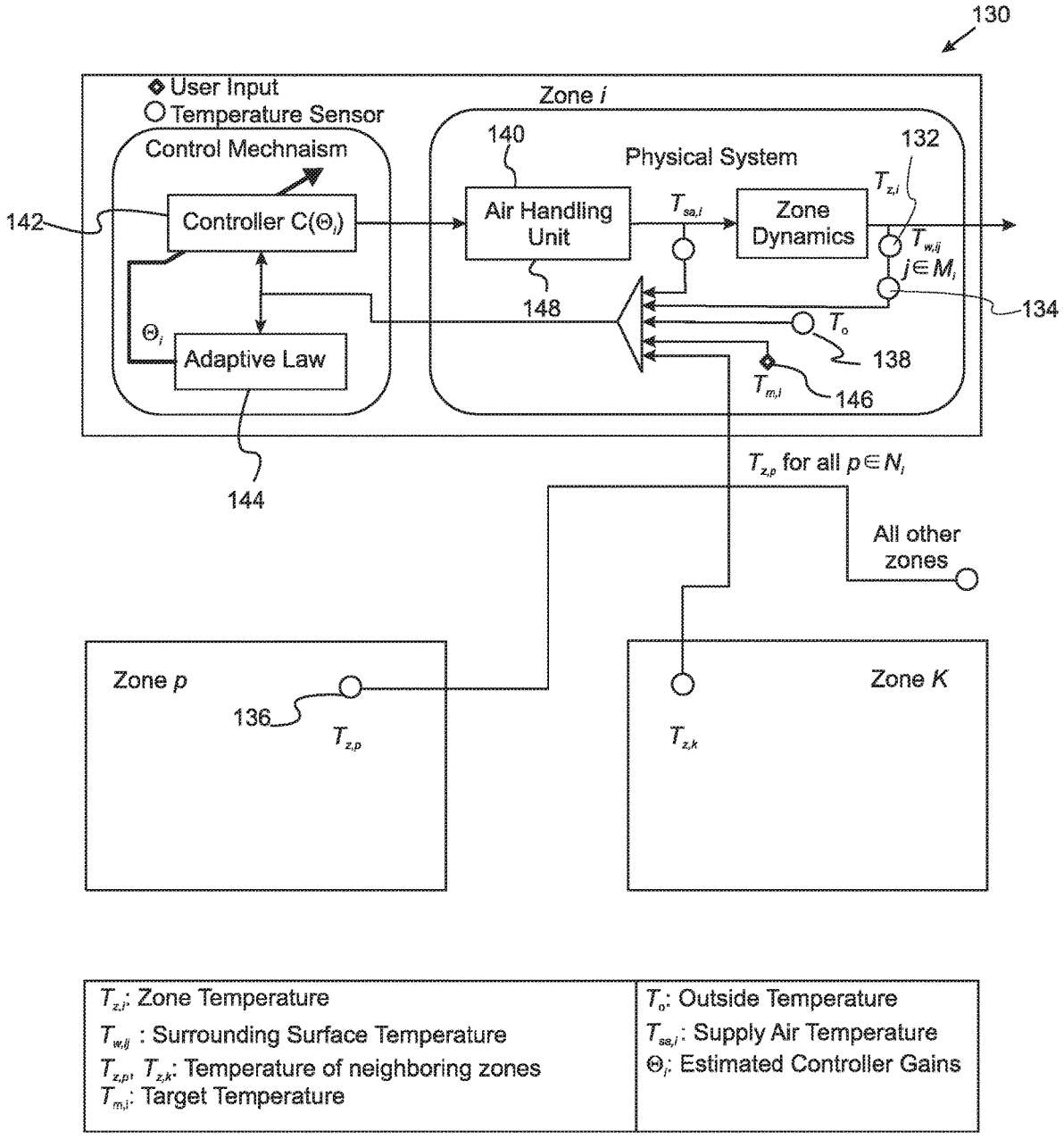
FIG. 1C: Control diagram for a zone in a building.

With reference to FIGS. 1A, 1B and 1C, schematic illustrations of an HVAC control system implemented in a building zone are provided. FIG. 1A is a perspective view of the building while FIG. 1B is a top view. As depicted, building 100 includes multiple zones 102-128 to be controlled by the HVAC control system. It should be appreciated that the control system is not limited to any particular number of zones in a building or to any building structure.

Figure 1D:
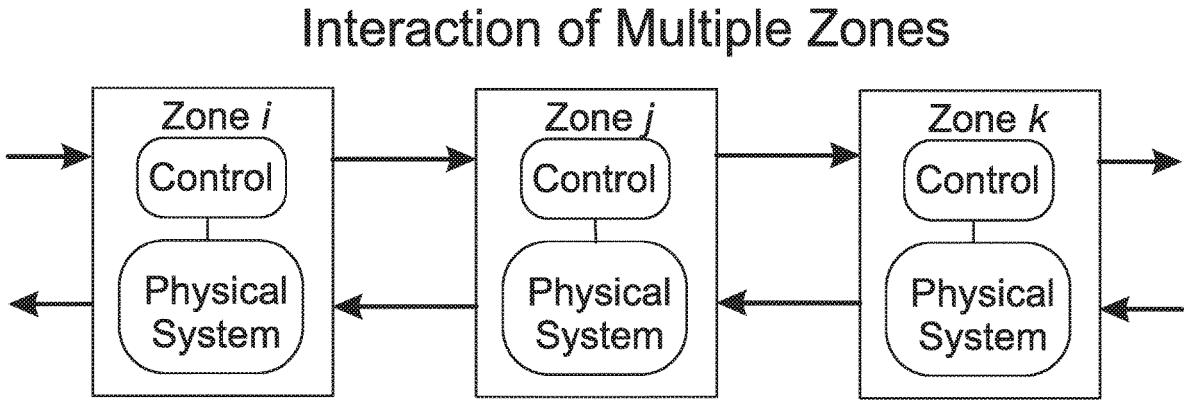
FIG. 1D: A block diagram showing the interaction of zones.

FIG. 1C provides a control diagram of an HVAC control system 130 integrated into one or more or all of the zones in building 100. FIG. 1D illustrates the interaction of zones with neighboring zones. With reference to FIG. 1C, zone temperature sensor 132 is positioned in a target zone i to measure target zone temperature $T_{z,i}$. The HVAC control system 130 can also communicate with one or more neighboring zone temperature sensors 136 that measure neighboring zone temperatures $T_{z,p}$ of one or more neighboring zones p. An outside temperature sensor 138 measures outside temperature $T_o$. The HVAC control system 130 also includes air handing unit 140 that is designed to provide supply air to the target zone at a supply air temperature $T_{sa,i}$ to match the desired supply air temperature that is calculated by the controller. Closed-loop controller 142 receives a target temperature $T_{m,i}$ for the target zone i, the target input being defined by the users of the systems through an appropriate temperature selection mechanism 146, and applies an estimated adaptive control law 144 to set the desired supply air temperature.

FIG. 1D illustrates a variation of the method for distributed adaptive control of temperature in a building with one or more zones. Characteristically, the estimated adaptive control law minimizes the effects of surroundings and activity in the target zone. It should be appreciated that the controller does not require any knowledge of the model parameters which are allowed to change with time. In a refinement, the HVAC control system 130 also includes one or more temperature sensors 138 that measure supply air temperature. In a refinement, the HVAC control system 130 also includes one or more wall temperature sensors 134 measure wall temperatures $T_{w,ij}$ of one or more walls bordering the target zone where i represents the zone being controlled and j is a wall or surrounding surface. In another refinement, the closed-loop controller 142 allows communication between zones with some delay. In a further refinement, the zone temperature approaches the target zone temperature with a response time less than 10 minutes.

In a variation, the estimated adaptive control law includes each of zone temperature, wall temperature(s) in the target zone, temperature(s) of neighboring zones, target temperature, and outside temperature connected to a corresponding automatically adjusted (adaptive) gain such that the zone temperature approaches the target zone temperature.

In a refinement, the estimated gains may vary with time according to some learning rule referred to as adaptive law.

In a particularly useful variation, a distributed HVAC control system for controlling temperature in a multizone building is provided. In this variation, each zone of the multizone building includes the HVAC control system 130 set forth above.

Figure 1E:
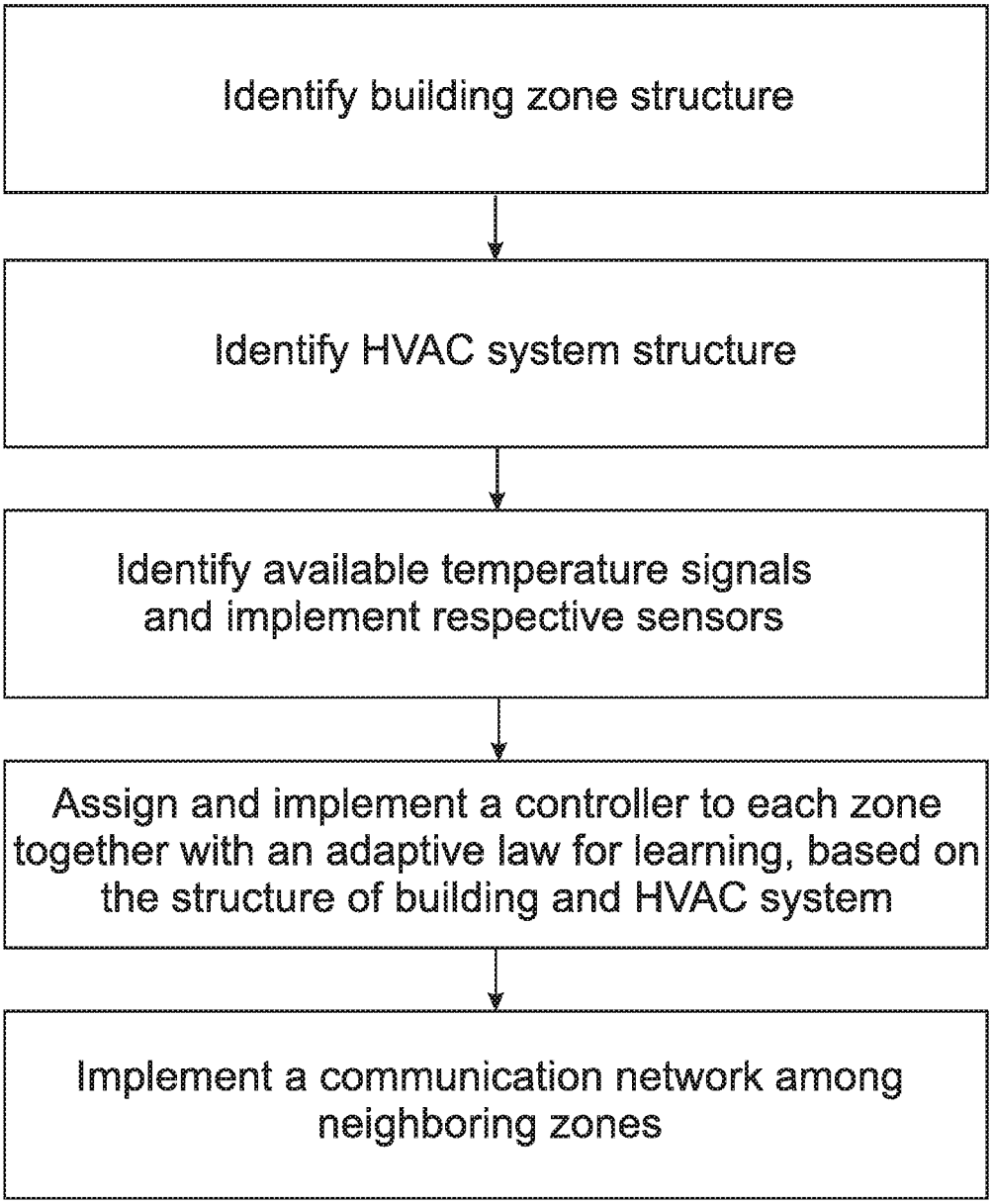
FIG. 1E: A flowchart that illustrates an embodiment of the method for HVAC systems control.

In another embodiment, a method for controlling temperature using the HVAC control system set forth above is provided. The method may include a step of defining building zones structure. The method may also include a step of defining the HVAC system structure. The method includes a step of measuring a target zone temperature for a target zone; measuring and communicating neighboring zone temperatures of one or more neighboring zones to the target zone; and measuring outside temperature. A target temperature is set for the target zone. Supply air is provided to the target zone at a supply air temperature, the supply air temperature being matched by the air handling unit to the desired supply air temperature, the desired supply air temperature being determined from an estimated adaptive control law, the estimated adaptive control law minimizing effects of surroundings and activity in the target zone. In a refinement, the method includes creating a communication network among the zones of the building. In a refinement, the method also includes measuring wall temperatures of one or more walls bordering the target zone. In some variations, the method includes measuring of working fluid temperature in the air handling unit. In an additional refinement, the desired flow of working fluid to the air handling unit is also determined from an estimated adaptive control law. In some variations, the method includes estimating the appropriate controlling input to control the HVAC system. An example of the method is illustrated in FIG. 1E.

Example Supply Air Control System

The high level heat transfer associated with the HVAC system in a typical building may be described by the following equations:

$$\frac{\Delta T_{z,i}}{\Delta t} = f_{1a}(T_{z,i}, T_{sa,i}, T_{w,ij}, T_{z,p}, T_o, q_i) \tag{1a}$$

$$\frac{\Delta T_{w,ij}}{\Delta t} = f_{1b}(T_{z,i}, T_{w,ij}, T_{z,p}, T_o) \tag{1b}$$

where $f_{1a}$ and $f_{1b}$ correspond to the high-level heat transfer functions and $q_i$ may represent model disturbance and heat gain and losses.

In one or more variations, the supplied air from the air unit has a direct impact on zone temperature. In some variations, climate conditions of neighboring zones may affect zone temperature through walls. In some variations, open surfaces between zones let heat transfer between zones. In some variations, heat gains or disturbances may affect zone temperature. In some variations, weather conditions may also affect zone temperature.

In some variations, to make the zone temperature $T_{z,i}$ reach the desired temperature target $T_{m,i}$ in each zone, the optimal supply air temperature $T_{sa,i}$ may be calculated by the controller. The air handling unit provides supply air with temperature that matches the desired one. In some configuration, the HVAC equipment may provide supply air with a constant volume flow rate. In one configuration, for each zone the signals that are available for measurement and use in the control design are the zone temperature $T_{z,i}$, the temperature of the walls $T_{w,ij}$, the desired temperature of the supply air $T_{sa,i}$, the temperature target $T_{m,i}$, as well as the zone temperature of the neighboring zones $T_{z,p}$ and the outside temperature $T_o$.

In at least one aspect, the control scheme does not need exact information on system dynamics but is able to react and tune itself constantly according to the changes. In an variation, the control input $T_{sa,i}$ is chosen, so that it provides the system with the desired performance characteristics regarding heat flow and at the same time may mitigate the effect of neighboring zones, wall temperature, outside weather conditions, disturbances or heat gains, and may be described in the high level by the following equation:

$$T_{sa,i}=f_2(T_{z,i},T_{sa,i},T_{w,ij},T_{z,p},T_o,T_{m,i},q_i,K,t) \tag{2}$$

where K are controller gains calculated by an adaptive law at each time instance and $f_2$ is a nonlinear dynamical function that represents the controller structure. Time t indicates the dependence on time, and this representation is inclusive and open-ended and does not exclude additional or alternative representations.

In some variations, the high level computation of controller gains K may be described by the following adaptive law:

$$K=f_3(T_{z,i},T_{sa,i}T_{w,ij}T_{z,p}T_o,T_{m,i},q_i,t) \tag{3}$$

where $f_3$ is a nonlinear function with dynamics that represents the adaptive law and t denotes the dependence on time, with the representation of time t being inclusive and open-ended and does not exclude additional or alternative representations. Different adaptive laws may be used to generate K at each time instance.

Some embodiments and examples of function $f_2$ that represent controller structures may be found in the cited references. Some embodiments and examples of function $f_3$ that represent adaptive laws may also be found in the cited references. While exemplary embodiments of the adaptive law are described in the cited references, it is not intended that these embodiments describe all possible forms of the adaptive law. Rather, it is understood that various adaptive laws, wherein learning of building and HVAC system parameters is implemented, may be implemented without departing from the spirit and scope of the invention.

The distributed adaptive control scheme guarantees the boundedness of temperature tracking error of every zone. In addition, zone temperature is guaranteed to approach the desired target temperature.

Figures 1, 2A:
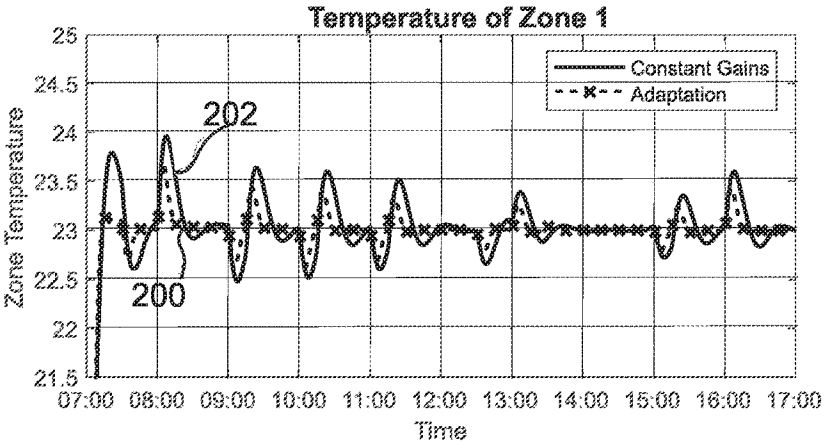
FIGS. 2A-1, 2A-2, 2A-3, and 2A-4: Exemplary temperature response of zones controlled with a distributed adaptive control system vs with a non-adaptive one.
Figures 2, 2A:
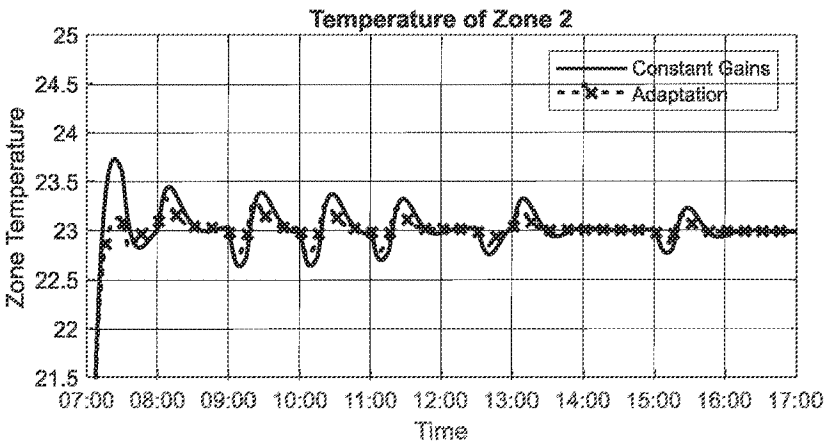
Figures 2, 2A, 3:
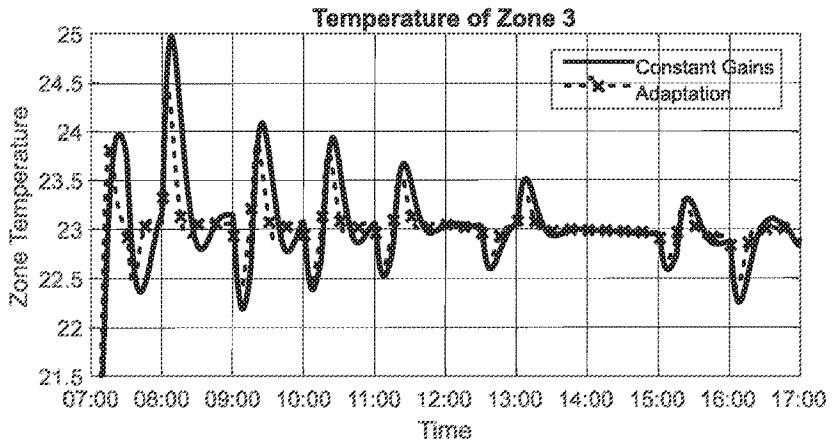

As set forth above FIG. 1A illustrates an example large building 100. The example building includes several zones with different thermal needs. Large rooms may be divided into several thermal zones. In the example shown in FIG. 1A, the example building is equipped with HVAC system 130 to regulate climate conditions. In FIG. 2A, a comparison of zone temperature tracking between the introduction of adaptation versus no adaptation is shown according to an exemplary embodiment and an exemplary day of operation for some example zones, wherein adaptation may include learning of building and HVAC system parameters. In the example shown in FIG. 2A, an exemplary embodiment of the distributed adaptive control scheme may result in faster reaching to the target temperature in example cases of door opening and closing or introduction of heat gains and disturbances. In the example illustrated in FIG. 2A, the temperature 200 of a zone controlled using the distributed adaptive control methodology tracks better the desired target temperature when compared to the temperature 202 of the same zone controlled by a methodology that does not include an adaptive law. In FIG. 2B, the calculated supply air temperature is illustrated for the example zones on the same example day in the example of FIG. 2A. Referring to FIG. 3, an example of controller gain adaptation for an example zone of the building throughout a year is presented. According to this example, introduction of a distributed adaptive control method may result to energy savings in the range of 5-15% throughout a year. In an exemplary embodiment, introduction of a distributed adaptive control method may improve zone temperature tracking accuracy in the range of 20-40%. In an embodiment, the distributed adaptive control scheme may retain the energy savings and zone temperature tracking accuracy when there exist material and equipment degradation. In another embodiment, the distributed adaptive control scheme may retain the energy savings and zone temperature tracking accuracy when compared to a control scheme that does not utilize information on neighboring zones.

In an exemplary configuration, an HVAC system controlled by the proposed scheme may operate, when it is turned on, without being calibrated. The controller may tune itself to accommodate the building needs satisfactorily.

Example HVAC System with Heat Exchangers

The high-level heat transfer associated with the HVAC system with heat exchangers in a typical building may be described by the equations (1a), (1b) and the following equations $$\frac{\Delta T_{sa,i}}{\Delta t} = f_{4a}(T_{z,i}, T_{sa,i}, T_{c,i}, T_o, q_i) \tag{4a}$$

$$\frac{\Delta T_{c,i}}{\Delta t} = f_{4b}(T_{c,i}, T_{sa,i}, T_{st}, T_o, q_i, \dot{m}_{c,i}) \tag{4a}$$

where $T_{c,i}$ may represent the temperature of the working fluid of the heat exchanger, $T_{st}$ may represent the temperature of the working fluid in the thermal storage or thermal source, $m_{c,i}$ may be the volume flow rate of the working fluid in the heat exchanger and $f_{4a}$ and $f_{4b}$ correspond to the high-level heat transfer functions.

In one or more embodiments, the supply air temperature may be affected by the temperature of the working fluid in the heat exchanger. In some variations, zone temperature may affect supply air temperature through the return. In some variations, disturbances may affect supply air temperature. In some variations, weather conditions may affect supply air temperature. In some variations, the temperature of the working fluid in the heat exchanger may be affected by the supply air temperature. In one or more configurations, the temperature of the working fluid in the heat exchanger may be affected by the temperature of the working fluid in the thermal storage or thermal source. In some variations, disturbances may affect the temperature of the working fluid in the heat exchanger. In some variations, weather conditions may affect the temperature of the working fluid in the heat exchanger.

In some variations, to make the zone temperature $T_{z,i}$ reach the desired temperature target $T_{m,i}$ in each zone, the optimal volume flow rate of the working fluid in the heat exchanger $m_{c,i}$ may be calculated by the controller. In a refinement, the closed-loop controllers (and the adaptive control law) may have a cascade structure according to equations (1a), (4a) and (4b). In one configuration, for each zone the signals that are available for measurement and use in the control design are the zone temperature $T_{z,i}$, the temperature of the walls $T_{w,ij}$, the desired temperature of the supply air $T_{sa,i}$, the temperature target $T_{m,i}$, as well as the zone temperature of the neighboring zones $T_{z,p}$, the outside temperature $T_o$, the temperature of the working fluid of the heat exchanger $T_{c,i}$, the temperature of the working fluid in the thermal storage or thermal source $T_{st}$ and the volume flow rate of the working fluid in the heat exchanger $m_{c,i}$.

In at least one aspect, the control scheme does not need exact information on system dynamics but is able to react and tune itself constantly according to the changes. In a variation, the control input $m_{c,i}$ is chosen, so that it provides the system with the desired performance characteristics regarding heat flow and at the same time may mitigate the effect of neighboring zones, wall temperature, outside weather conditions, disturbances or heat gains, and may be described in the high level by the following equation:

$$m_{c,i}=f_5(T_{z,i}, T_{sa,i}, T_{w,ij}, T_{z,p}, T_o, T_{m,i}, q_i, T_{c,i}, T_{st}, K) \tag{5}$$

where K are controller gains calculated by an adaptive law at each time instance and $f_5$ is a nonlinear dynamical function that represents the controller structure.

In some variations, the high-level computation of controller gains K may be described by the following adaptive law:

$$K=f_6(T_{z,i}, T_{sa,i}, T_{w,ij}, T_{z,p}, T_o, T_{m,i}, q_i, T_{c,i}, T_{st}, K, t) \tag{6}$$

where $f_6$ is a nonlinear function with dynamics that represents the adaptive law.

The distributed adaptive control scheme guarantees boundedness of temperature tracking error of every zone. In addition, zone temperature is guaranteed to approach the desired target temperature.

Figures 2, 2A, 3, 4:
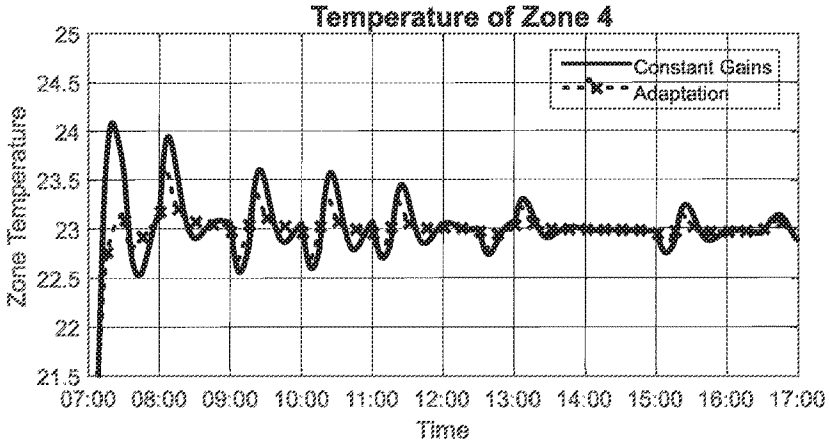
Figures 1, 2B:
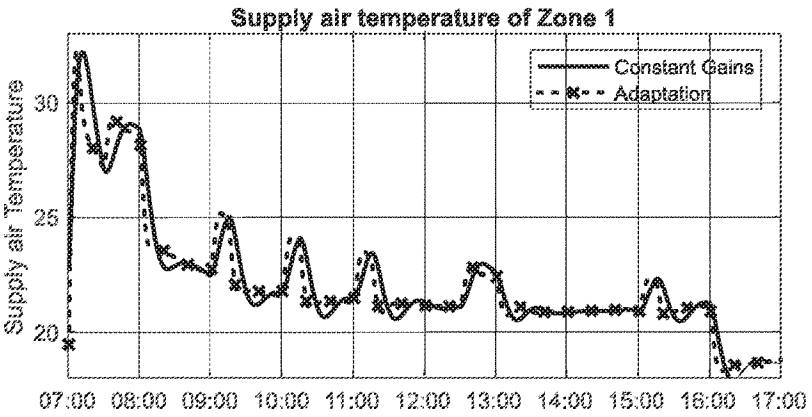
Figures 2, 2B:
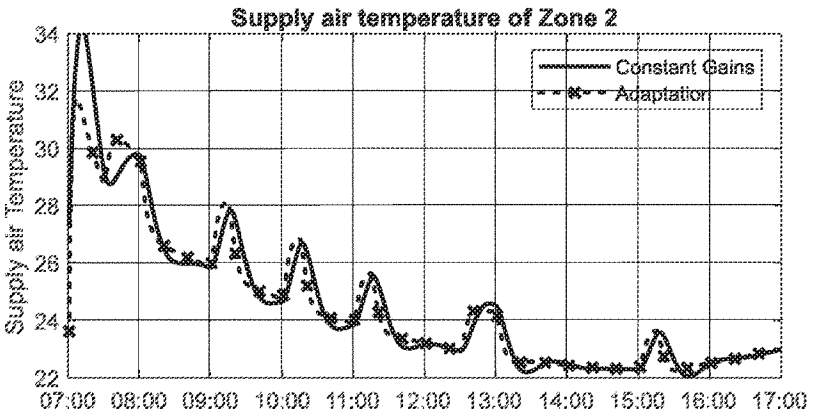
Figures 2, 2B, 3:
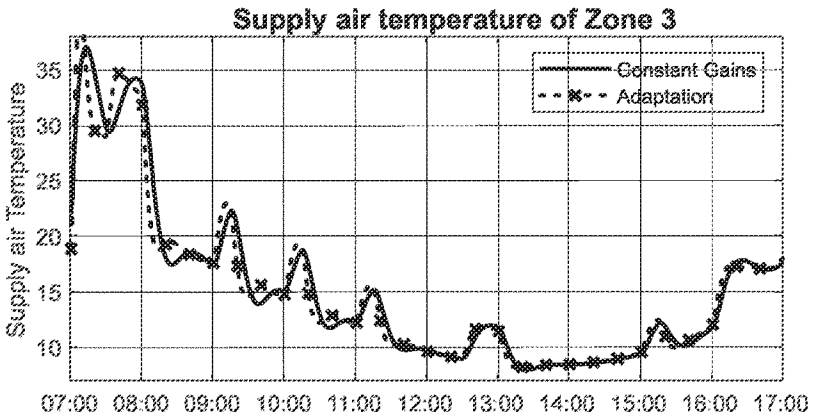
Figures 2, 2B, 3, 4:
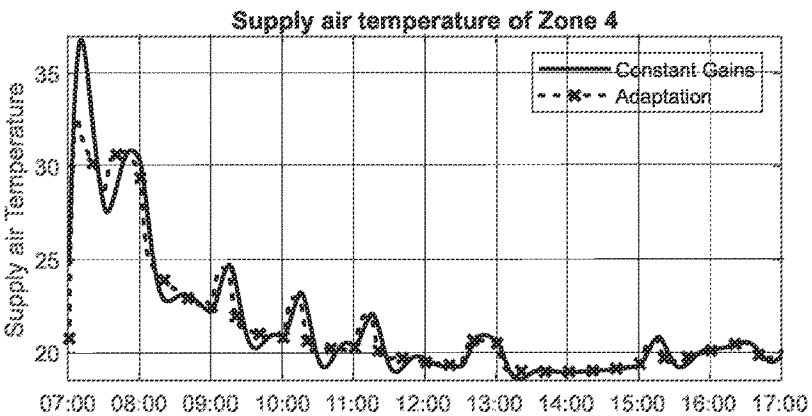
Figure 3:
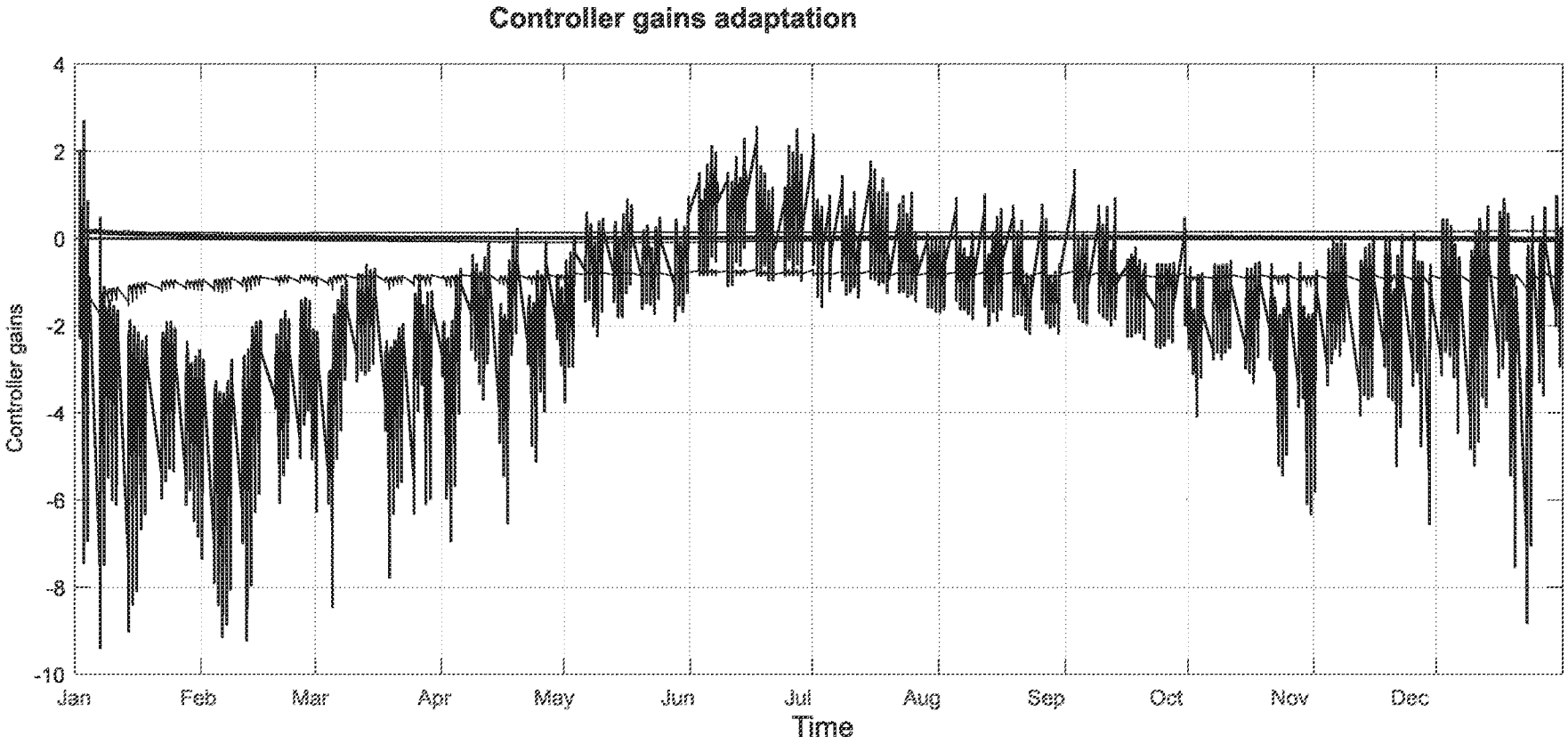

Referring to FIG. 4, illustrated is an exemplary embodiment of the controller structure in one zone in a multi-zone building with HVAC equipment with heat exchangers 400. In the example shown in FIG. 1A, the example building 100 is equipped with an HVAC system to regulate climate conditions, wherein the volume flow rate of the working fluid in the heat exchangers is to be controlled using the illustrated valves 402. With reference to FIG. 4, temperature sensor 406 may be positioned in a heat exchanger to measure temperature $Th_{he,i}$ of working fluid in the heat exchanger. Temperature sensor 408 may be positioned in a thermal storage or source to measure temperature $T_{st1,i}$ of working fluid in the thermal storage or source. In an exemplary variation, the heat exchanger 400 may determine the supply air temperature of a supply air terminal unit or air distribution unit 404. According to an exemplary variation, introduction of a distributed adaptive control method may result in energy savings in the range 5-15% throughout a year. In an exemplary variation, introduction of a distributed adaptive control method may improve zone temperature tracking accuracy in the range of 20-40%. In a configuration, an HVAC system controlled by the proposed scheme may operate, when it is turned on, without being calibrated. The controller may tune itself to accommodate the building needs satisfactorily.

Configuration of Exemplary Embodiments

The construction and arrangement of the systems and methods as shown in the various exemplary embodiments are illustrative only. Although only a few embodiments have been described in detail in this disclosure, many modifications are possible (e.g. variations in sizes, buildings, HVAC equipment, structures, dimensions, shapes, materials, etc.). For example, the computation of the control input may be implemented in an analog system or a digital system. In another example, the control input computation may or may not include all temperature measurements of neighboring zones and surrounding walls and surfaces. In another example, the distributed adaptive control method may determine and compute supply air volume flow rate as the control input. Accordingly, all such modifications are intended to be included within the scope of the present disclosure. The controller structure or adaptive law may be varied and modified according to alternative embodiments. Other substitutions, modifications and changes, and omissions may be made in the design, operating conditions, and arrangement of the exemplary embodiments without departing from the scope of the present disclosure.

The embodiments, variations, and refinements of the present disclosure may be implemented using digital or analog processors, existing processors or special purpose processors for the appropriate systems. The communication between zones, equipment and elements may be implemented by hardware or by any network communication-related method. Combinations of the above are also included within the scope of the disclosure.

Although some figures may show a specific order of method steps, the order of the steps may differ from what is depicted, according to the choices of adaptive law or controller structure or HVAC equipment or software system or hardware system or combinations of them. All such variations are within the scope of the disclosure. Likewise, software implementations or hardware implementations could be accomplished with standard programming techniques and other logic to accomplish the various communication steps, connection steps, computation steps, and decision steps.

Additional details of the invention are set forth in G. Lymperopoulos and P. Ioannou, "*Distributed Adaptive Control of Multi-Zone HVAC Systems,*" 2019 27th Mediterranean Conference on Control and Automation (MED), Akko, Israel, 2019, pp. 553-558; the entire disclosure of which is hereby incorporated by reference.

While exemplary embodiments, variations, and refinements are described above, it is not intended that these embodiments, variations, and refinements describe all possible forms of the invention. Rather, the words used in the specification are words of description rather than limitation, and it is understood that various changes may be made without departing from the spirit and scope of the invention. Additionally, the features of various implementing embodiments, variations, and refinements may be combined to form further embodiments of the invention.

REFERENCES CITED

P. Ioannou and B. Fidan, Adaptive Control Tutorial (Advances in Design and Control). SIAM, Society for Industrial and Applied Mathematics, 2006.

P. Ioannou and J. Su, Robust Adaptive Control, Dover Publications, Inc., 2012.

What is claimed is:

1. A heating, ventilation, and air conditioning (HVAC) control system comprising:

one or more zone temperature sensors positioned in building zones that measure zone temperature;

one or more or zero wall temperature sensors that measure wall temperature of one or more walls bordering the building zones;

one or more neighboring zone temperature sensors that measure neighboring zone temperatures of one or more neighboring zones;

one or more supply air temperature sensors that measure supply air temperature of one or more zones;

a communication network between neighboring zones;

an outside temperature sensor that measures outside temperature; one or more air handling units that provide supply air to target zones at a supply air temperature; and a distributed adaptive control system that includes a plurality of closed-loop controllers with a closed-loop controller in each target zone, wherein the closed loop controllers do not need any knowledge of model parameters and such model parameters may change with time, each closed-loop controller configured to receive a target zone temperature and apply an estimated adaptive control law that applies automatically adjusted adaptive gain to set the supply air temperature or a volume flow rate of working fluid in one or more heat exchangers, the estimated adaptive control law minimizing effects of surroundings and activity in the target zones while mitigating effects of neighboring zones, disturbances, and heat gains, wherein the supply air is provided to a target zone by the one or more air handling units at the supply air temperature determined by the estimated adaptive control law, wherein the distributed adaptive control system is configured to guarantee boundedness of the temperature tracking error of every zone.

2. The HVAC control system of claim 1 further comprising:

one or more working fluid temperature sensors that measure temperatures of working fluids in heat exchangers;

one or more working fluid temperature sensors that measure temperatures of working fluids in thermal storages or sources; and one or more thermal storages or sources.

3. The HVAC control system of claim 2 wherein the estimated adaptive control law receives as inputs target zone temperature, wall temperature(s) in the target zones, temperature(s) of neighboring zones, target temperature, outside temperature, supply air temperature, temperature of working fluids in the heat exchangers, and temperature of working fluids in thermal storage or source each connected to a corresponding automatically adjusted adaptive gain such that a zone temperature approaches the target zone temperature.

4. The HVAC control system of claim 1 wherein each closed-loop controller sets a control input of the HVAC system.

5. The HVAC control system of claim 1 wherein the estimated adaptive control law receives as inputs target zone temperature, wall temperature(s) in the target zones, temperature(s) of neighboring zones, target temperature, outside temperature, supply air temperature each connected to a corresponding automatically adjusted (adaptive) gain such that a zone temperature approaches the target zone temperature.

6. The HVAC control system of claim 1 wherein a zone temperature approaches the target zone temperature with a predetermined response time.

7. The HVAC control system of claim 1 wherein the estimated adaptive control law implements learning of building and HVAC system parameters.

8. The HVAC control system of claim 1 wherein each closed-loop controller and the estimated adaptive control law have a cascade structure.

9. The HVAC control system of claim 1 wherein each closed-loop controller allows communication between zones with some delay.

10. The HVAC control system of claim 1 wherein each closed-loop controller does not require any knowledge of model parameters that are allowed to change with time.

11. The HVAC control system of claim 1 wherein each closed-loop controller calculates an optimal supply air temperature.

12. The HVAC control system of claim 1 wherein each closed-loop controller calculates an appropriate volume flow rate of working fluid in the heat exchangers.

13. The HVAC control system of claim 1 wherein the control system extends the life of HVAC equipment by compensating for a wide range of tear and wear and other equipment defects.

14. A distributed adaptive HVAC control system for controlling temperature in a multizone building, wherein each zone of the multizone building includes the HVAC control system of claim 1.

15. The HVAC control system of claim 1, wherein a room is divided into several thermal zones.

16. The HVAC control system of claim 1, wherein system parameters are considered unknown and controller gains are estimated on-line by an adaptive law.

17. A method for controlling temperature comprising: measuring a target zone temperature for each target zone in a plurality of target zones;

measuring wall temperatures of one or more or zero walls bordering the target zone;

measuring and communicating neighboring zone temperatures of one or more neighboring zones to each target zone;

measuring outside temperature;

setting a target temperature for each target zone; and providing supply air to each target zone at a supply air temperature, the supply air temperature being matched by an air handling unit to an optimal supply air temperature, the supply air temperature being determined from an estimated adaptive control law that applies automatically adjusted adaptive gain, the estimated adaptive control law minimizing effects of surroundings and activity in the target zone while mitigating effects of neighboring zones, disturbances, and heat gains, wherein supply air is provided to a target zone by one or more air handling units at the supply air temperature determined by the estimated adaptive control law, the estimated adaptive control law being implemented by a distributed adaptive control system that includes a plurality of closed-loop controllers with a closed-loop controller in each target zones, wherein the closed loop controllers do not need any knowledge of model parameters and such model parameters may change with time, wherein the distributed adaptive control system is configured to guarantee boundedness of the temperature tracking error of every zone.

18. The method of claim 17 further comprising:

providing working fluids to one or more heat exchangers;

measuring temperatures of the working fluids in one or more heat exchangers; and measuring temperatures of the working fluids in one or more thermal storages or sources, wherein a volume flow rate of the working fluids is determined from the estimated adaptive control law.

19. The method of claim 17 wherein the supply air temperature is controlled by a HVAC control system comprising:

one or more zone temperature sensors positioned in the zones that measure zone temperatures;

one or more or zero wall temperature sensors that measure wall temperature of one or more walls bordering the zones;

one or more neighboring zone temperature sensors that measure neighboring zone temperature of one or more neighboring zones;

one or more supply air temperature sensors that measure supply air temperature of one or more zones;

a communication network between neighboring zones;

an outside temperature sensor that measures outside temperature;

one or more air handling units that provide supply air to the target zone at the supply air temperature; and one or more closed-loop controllers that receive a target temperature for each target zone and apply the estimated adaptive control law that applies automatically adjusted adaptive gain to set the supply air temperature or a volume flow rate of working fluids in one or more heat exchangers, the estimated adaptive control law minimizing effects of surroundings and activity in the target zone while mitigating effects of neighboring zones, disturbances, and heat gains, wherein supply air is provided to a target zone by the one or more air handling units at the supply air temperature determined by the estimated adaptive control law.

20. The method of claim 19 wherein a predetermined volume flow rate of the working fluids in the heat exchangers are controlled by the HVAC control system.

21. The method of claim 19 wherein the one or more closed-loop controllers sets control inputs of the HVAC system.

* * * * *